US008479965B2

(12) United States Patent
Chen

(10) Patent No.: US 8,479,965 B2
(45) Date of Patent: Jul. 9, 2013

(54) AUTO HAMMER

(75) Inventor: Liang Chen, Nanjing (CN)

(73) Assignee: Chervon Limited, Hong Kong (HK)

( * ) Notice: Subject to any disclaimer, the term of this patent is extended or adjusted under 35 U.S.C. 154(b) by 364 days.

(21) Appl. No.: 12/949,993

(22) Filed: Nov. 19, 2010

(65) Prior Publication Data

US 2011/0120739 A1 May 26, 2011

(30) Foreign Application Priority Data

Nov. 21, 2009 (CN) ..... 2009 1 0233202

(51) Int. Cl.
*B25C 1/06* (2006.01)

(52) U.S. Cl.
USPC ..... 227/119; 227/147; 81/44; 269/229; 269/237

(58) Field of Classification Search
USPC ..... 227/119, 129, 140, 144, 147, 149; 81/44, 81/454–455, 464; 269/229, 237, 3, 6
See application file for complete search history.

(56) References Cited

U.S. PATENT DOCUMENTS

| | | | | |
|---|---|---|---|---|
| 3,858,430 | A * | 1/1975 | Kushnarenko et al. | 72/430 |
| 5,671,642 | A * | 9/1997 | Haas | 81/57.37 |
| 6,516,989 | B1 * | 2/2003 | Sun | 227/120 |
| 7,789,282 | B2 * | 9/2010 | Fukinuki et al. | 227/131 |
| 2008/0054043 | A1 * | 3/2008 | Beales | 227/129 |
| 2009/0045241 | A1 * | 2/2009 | Fukinuki et al. | 227/131 |

FOREIGN PATENT DOCUMENTS

| | | |
|---|---|---|
| GB | 1394773 | 5/1975 |

* cited by examiner

*Primary Examiner* — Alexandra Elve
*Assistant Examiner* — Andrew M Tecco
(74) *Attorney, Agent, or Firm* — Greenberg Traurig, LLP

(57) ABSTRACT

An auto hammer has a housing, a grip portion and a striking device. The striking device has a striking rod that can strike a fastening element using a liner reciprocating motion. The striking device also has an associated clamping mechanism for clamping the fastening element. The clamping mechanism includes a clamping member, a driving part and a sliding member, wherein the clamping member is pivotally arranged in the sliding member and is connected to the driving part, and the driving part can rotate relative to the sliding member so as to cause the clamping member to rotate pivotally in the sliding member. The clamping mechanism may thus firmly clamp the fastening element in a manner that is convenient for users.

15 Claims, 11 Drawing Sheets

AUTO HAMMER

BACKGROUND

The follows generally relates to auto hammers and, more specifically, to an auto hammer with a clamping mechanism.

In the fitment and decoration fields, the auto hammer is a commonly used tool. For example, Chinese patent application No. 200820161342.1 discloses an auto hammer, which comprises a housing and a nozzle portion connected to the housing. The nozzle portion is generally formed of a hollow cylindrical sleeve. A hole for receiving a magnet is drilled in the sleeve, and the magnet engages into the hole so as to attract a nail arranged in the striking device for clamping the nail. The disadvantages of this auto hammer are: the magnet is arranged on the edge of the sleeve, thus the nail cannot be located in the centre of the sleeve and cannot be positioned parallel to the centre line of the sleeve (that is to say, the nail is inclined after being attracted), and the magnet cannot clamp other non-magnetic materials, for example, wooden tenons and the like.

SUMMARY

The following describes an auto hammer improved to overcome the problems existing in the prior art, particularly to provide an auto hammer wherein the nail or other elements can be firmly clamped in the striking device, so that it is convenient for users.

To this end, an auto hammer with simple manipulation, good visibility and compact structure is provided, which comprises a striking device with a clamping mechanism. The clamping mechanism comprises at least one clamping member, a driving part and a sliding member, wherein at least one clamping member is pivotally arranged in the sliding member and connected to the driving part, and the driving part can rotate relative to the sliding member so as to cause the clamping member to rotate pivotally in the sliding member. The clamping member can grip a nail in a larger area, so that a good effect for gripping may be obtained.

Further, the sliding member is provided with an inclined slot and a pin passes through the inclined slot and the driving part and moves along the inclined slot.

Further, the clamping member can be any one or any combination of elements in the group consisting of a chuck jaw, spring, magnet, bolt and chuck for retaining an element.

Further, the striking device also has a striking rod and a releasing area is formed when the clamping member is located at the opened position such that the striking rod may pass through the releasing area.

Further, the clamping mechanism comprises a bush and a bracket and the bush may engage with the bracket.

Further, the clamping mechanism comprises a first biasing device for biasing the sliding member towards the workpiece.

Further, the clamping mechanism comprises a second biasing device for biasing the bush towards the workpiece.

Further, the clamping mechanism comprises three clamping members and each paired set of clamping members can be interlocked with each other.

Further, the clamping mechanism comprises a locking mechanism including a projection and a spanner, wherein the clamping members are located at the opened position when the projection is locked with the spanner, and the striking rod is emerged out of the sliding member when the projection is locked with the spanner at another position.

Further, the sliding member is made of transparent material.

Further, the striking rod applies a striking force to the element to move it, and a transmitting mechanism is used to convert the rotational motion of a motor into the liner reciprocating motion of the striking rod.

Further, the striking rod may strike the element many times so that the element can be gradually inserted into the workpiece.

Further, the transmitting mechanism comprises an impact wheel with at least one projection, and the projection may apply a periodically impact motion to the striking rod.

BRIEF DESCRIPTION OF THE DRAWINGS

Detailed embodiments of the subject auto hammer are described below in conjunction with the attached drawings in which.

DETAILED DESCRIPTION

Figure 1:
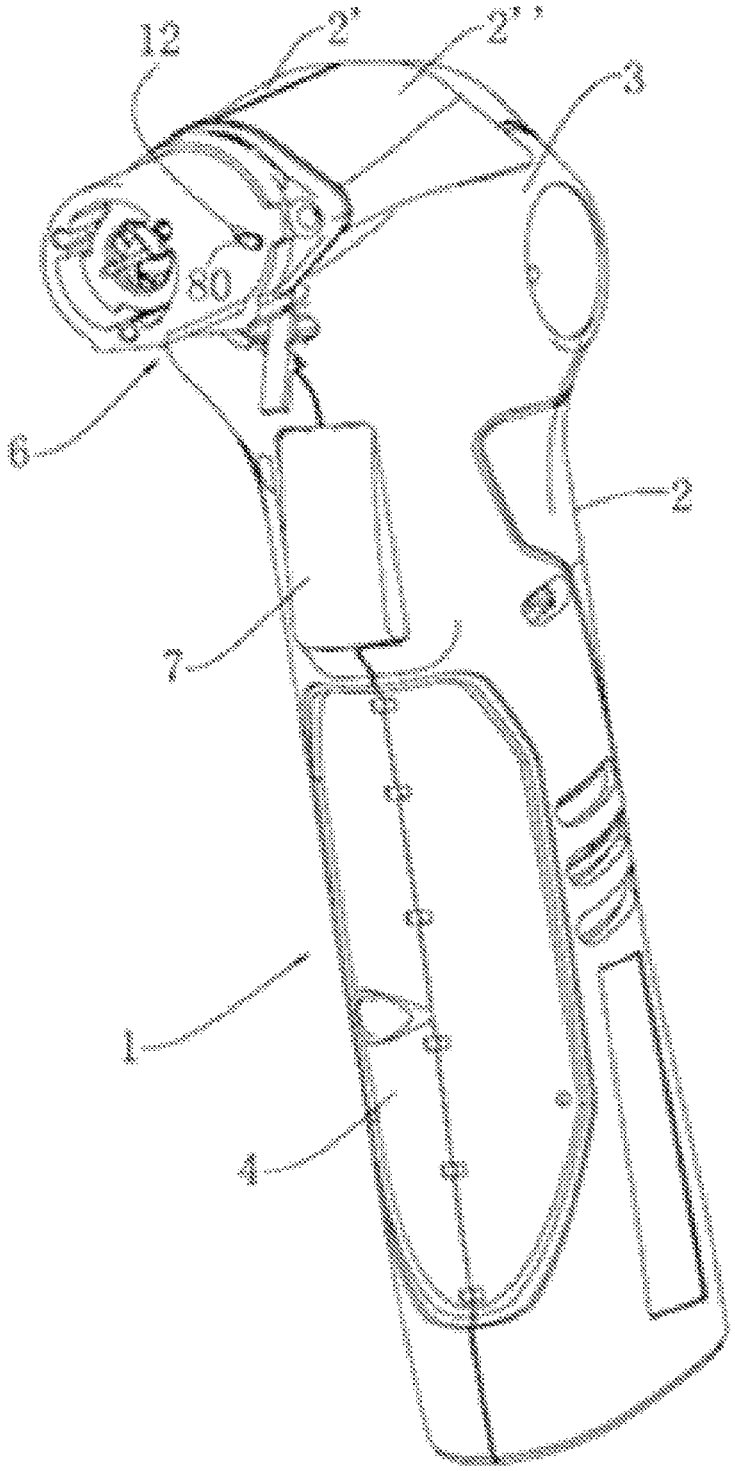
FIG. 1 is a perspective view illustrating an auto hammer according to one embodiment of the present invention.

As shown in FIGS. 1-4, the auto hammer 1 of the present embodiment comprises a housing 2 which accommodates a motor M therein and a striking device 6. The housing 2 is composed of two housing halves, i.e., the left and right half housings 2' and 2". The main body of the housing 2 forms a substantially vertical grip portion 4, and the housing 2 comprises a head assembly 3 on its upper end. The head assembly comprises a transmission mechanism and the striking device 6.

In this exemplary embodiment, the auto hammer 1 has a battery pack (not shown) for supplying power to the motor M. However, the auto hammer need not be restricted to the use of a DC power supply and may be equally powered by a source of AC power. A switch 7 is arranged on the housing 2 for controlling the motor (not shown). The striking device 6 comprises a striking rod 61 which is substantially horizontal as illustrated and arranged in the striking device 6 by a spring and which can move in linear reciprocating manner therein. During operation, the end surface of the striking end 611 of the striking rod 61 may act on elements, for example, fasteners such as nails or wooden tenons or objects such as bricks. The striking device 6 also has a receiving cavity 63 that is designed as a retractable configuration and may contact the surface of the workpiece to be processed. Furthermore, the receiving cavity 63 has a larger inner diameter than a general fastener so that fasteners with different sizes may be positioned into the receiving cavity.

Figure 3:
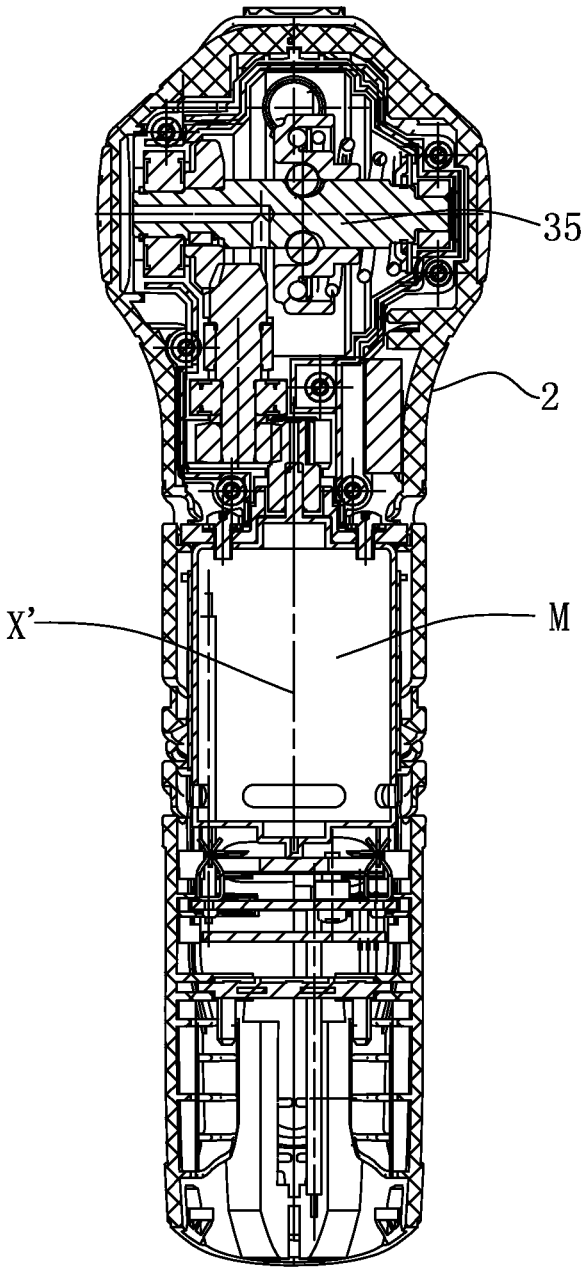
FIG. 3 is a sectional view of the auto hammer in FIG. 1 taken along a surface which is vertical to the combination surface of the two housing halves.
Figure 4:
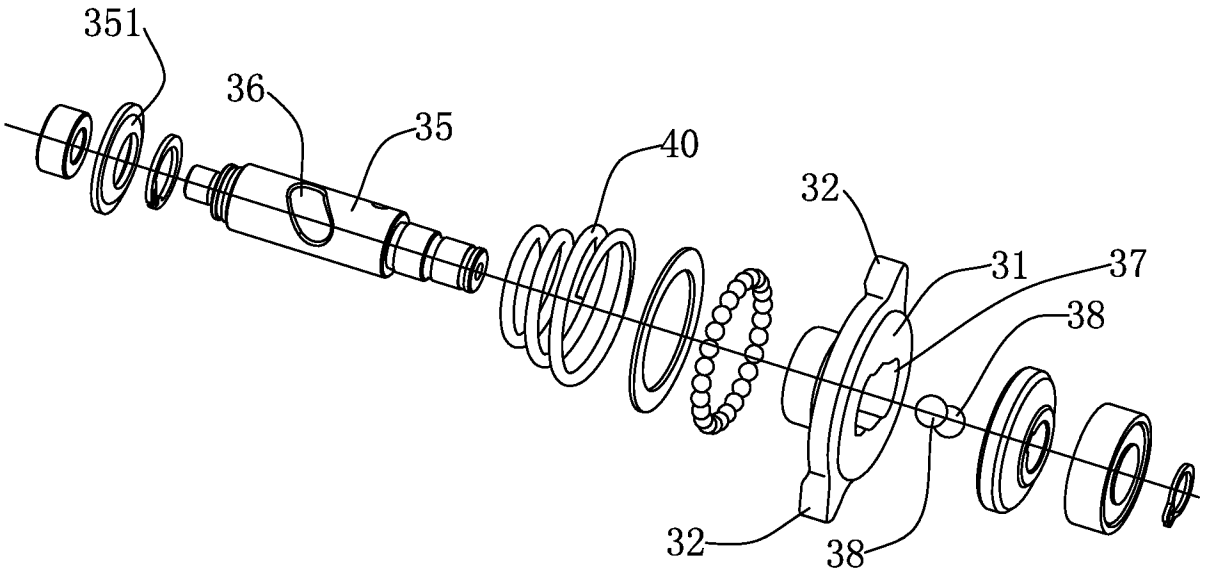
FIG. 4 is a partial exploded view of a transmitting device of the auto hammer in FIG. 1.

As shown in FIGS. 3-4, a rotary-linear movement transmission mechanism is arranged in the housing 2 for converting the rotational movement of the motor M into the impacting movement of the striking rod 61. The motor M is vertically arranged in the housing 2 as illustrated. The upward motor shaft X' thereof transmits the rotation power of the motor M to a rotating shaft 35 by means of a multistage gear transmission including bevel gears. The rotating shaft 35 is supported on the upper portion of the housing by bearings on two ends. The rotating shaft 35 is provided with a pair of inclined slots 36, and each of the inclined slots 36 is formed with a general "V" shape which opens backwards. An impact wheel 31 surrounds the rotating shaft 35 and is generally a hollow cylinder, with a pair of circular-arc guiding slots 37 arranged in the inner cylindrical surface thereof and opposite to the two inclined slots 36 respectively. The bottoms of the inclined slots 36 and the guiding slots 37 are provided with a semi-circular-arc. A pair of steel balls 38 are respectively positioned in the chambers formed between the inclined slots 36 and the guiding slots 37, and the steel balls 38 may move relatively along the inclined slots 36 and the guiding slots 37. Thus, when the rotating shaft 35 rotates, the impact wheel 31 may be driven to rotate by the steel balls 38 in the inclined slots 36. A pair of projections 32, which projections are disposed oppositely along the diameter direction of the impact wheel 31, is provided on the outer circumference of the impact wheel 31. After turning on the switch 7, the motor M is powered to drive the rotating shaft 35 to rotate by the multistage gear transmission, and then the impact wheel 31 is driven to rotate together therewith by the steel balls 38.

As shown in FIG. 4, an energy storing spring 40 is arranged between the impact wheel 31 and the rotating shaft 35 in such a manner that one end of the energy storing spring 40 bears against the shoulder 351 of the rotating shaft 35 and the other end bears against the impact wheel 31. With the axial force of the energy storing spring 40, the impact wheel 31 is located in a first axial position relative to the rotating shaft 35. In the first axial position, the impact wheel 31 moves in a circle under the action of the rotating shaft 35 and steel balls 38. When the impact wheel 31 rotates to a position where the projection 32 may contact the striking rod 61, the striking rod 61 encounters a large resistance force that cannot be overcome for the moment, thus the striking rod 61 stops the impact wheel 31 rotating temporarily, and then the impact wheel 31 gradually compresses the energy storing spring 40 and moves from the first axial position to a second axial position. In the second axial position, the projection 32 of the impact wheel 31 departs from the striking rod 61, and the stopping energy is released, i.e., the energy storing spring 40 starts to release its elastic potential energy. Under a function of the rebound axial force of the energy storing spring 40, the impact wheel 31 is pressed back to the first position, and is moved at a higher speed than that of the rotating shaft 35 with the cooperation of the inclined slots 36, the guiding slots 37 and the steel balls 38. As a result, the projection 32 of the impact wheel 31 impacts the stricken end 612 of the striking rod 61, and the striking rod 61 moves at a high speed in a linear direction and thereby one impact is achieved. After the first impact is finished, the second impact cycle starts when the impact wheel 31 is driven to rotate to be stopped by the striking rod 61 again, and the next following impact process will be completed in the same manner.

Figure 2:
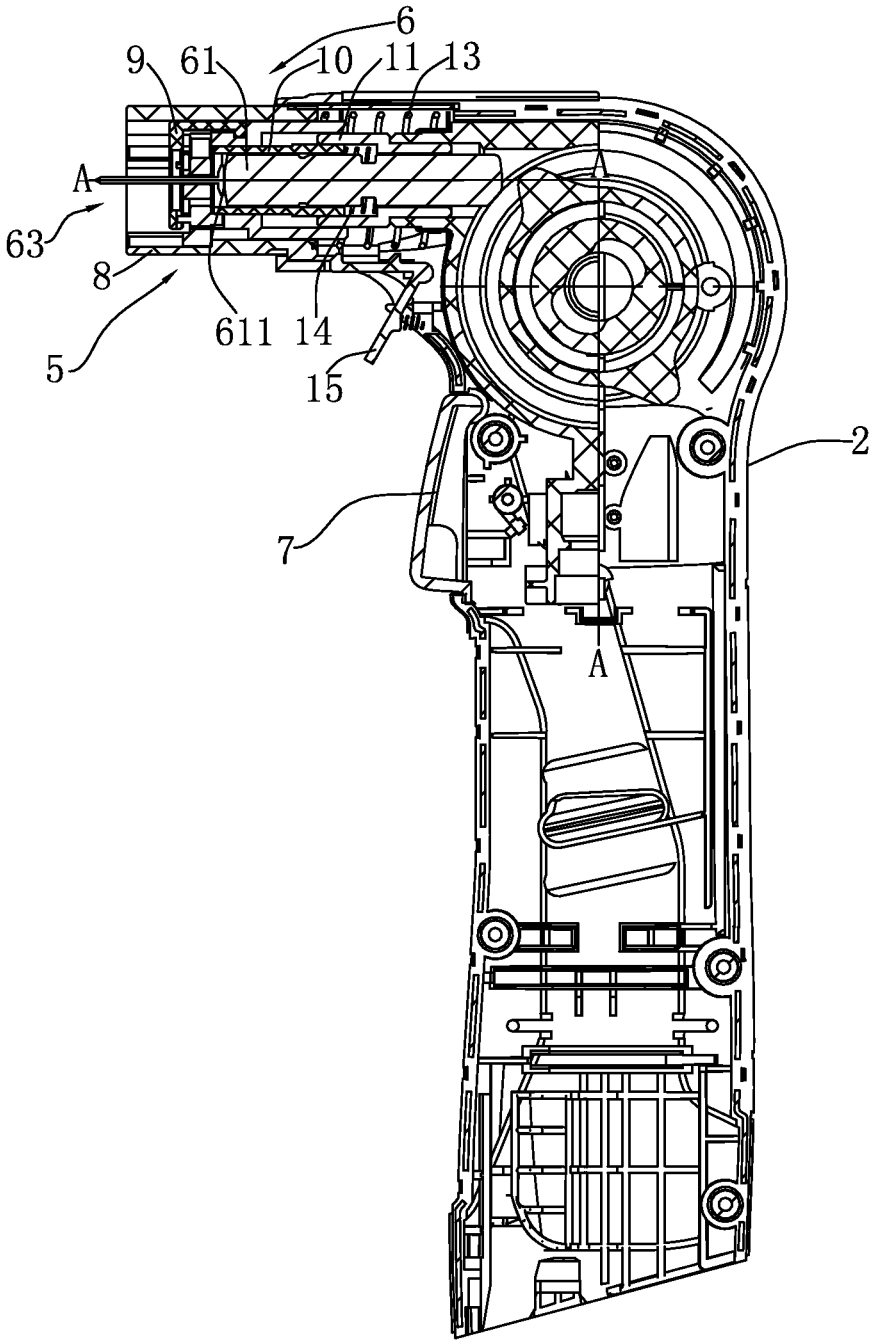
FIG. 2 is a sectional view of the auto hammer in FIG. 1 taken along the combination surface of the two housing halves.
Figure 5:
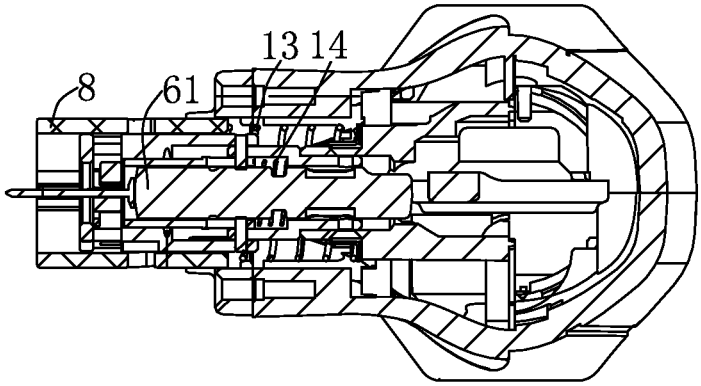
FIG. 5 is a sectional view of the auto hammer in FIG. 2 taken along the axial line A-A.
Figure 6:
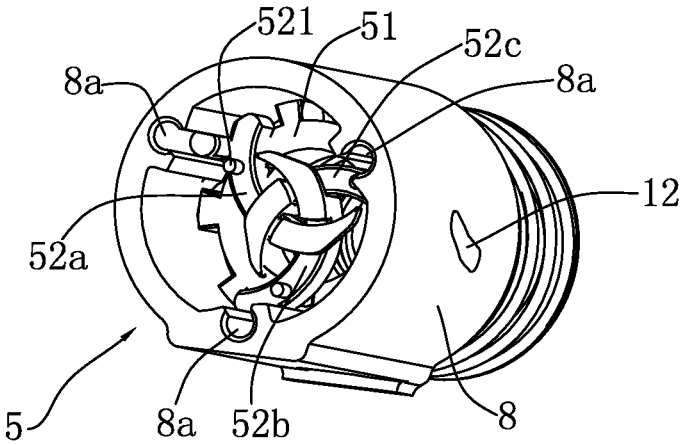
FIG. 6 is a perspective view of a clamping mechanism of the auto hammer in FIG. 1, wherein the clamping members are located at the closed position.
Figure 7:
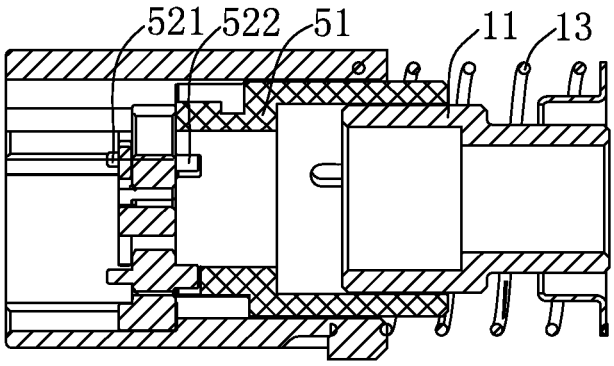
FIG. 7 is a sectional view of the clamping mechanism in FIG. 6 taken along the combination surface of the two housing halves.
Figure 8:
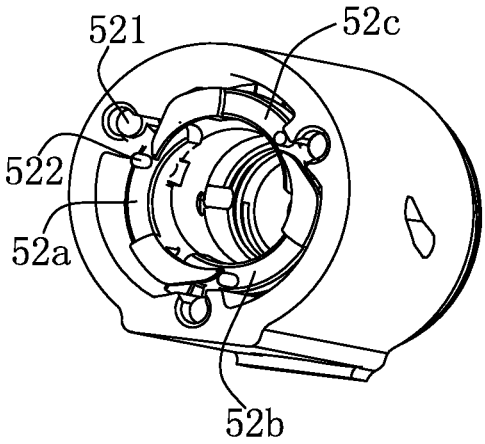
FIG. 8 is a perspective view of the clamping mechanism of the auto hammer in FIG. 1, wherein the clamping members are located at the opened position.
Figure 9:
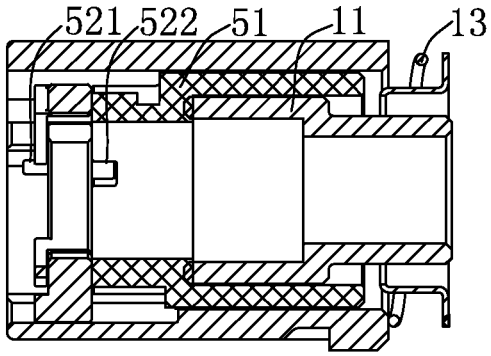
FIG. 9 is a sectional view of the clamping mechanism in FIG. 8 taken along the combination surface of the two housing halves.
Figure 10:
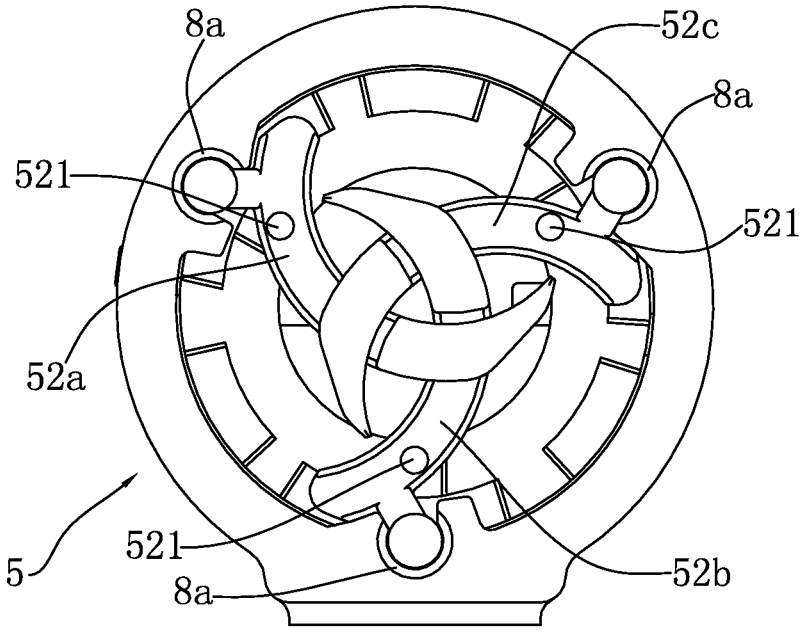
FIG. 10 is a left view of the clamping mechanism in FIG. 6.
Figure 11:
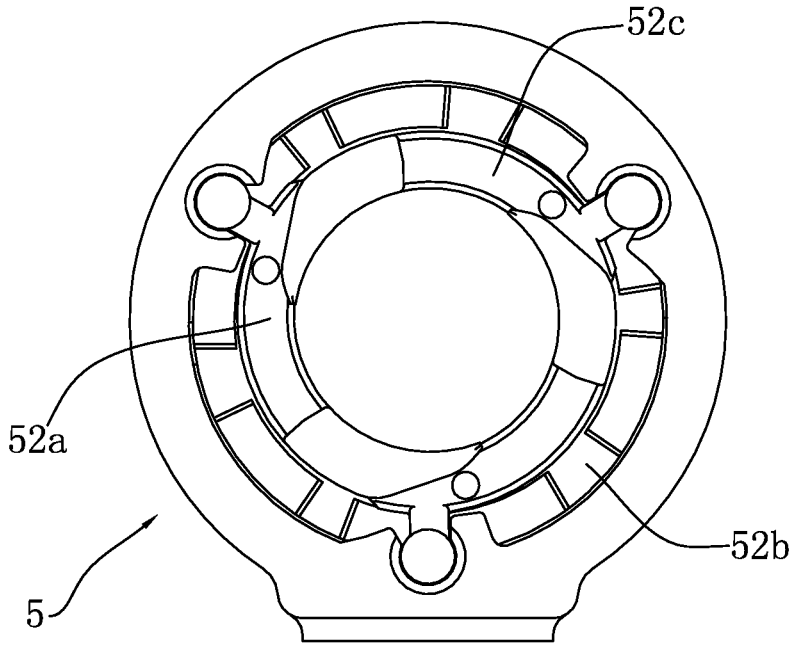
FIG. 11 is a left view of the clamping mechanism in FIG. 8.

As shown in FIGS. 2, 5 and 6, a clamping mechanism 5 is provided in the striking device 6 for clamping a nail or other fastening elements. The clamping mechanism 5 is in the form of clamping members 52*a*, 52*b* and 52*c*. One end of each clamping member is pivotally arranged on the sliding member 8 and these clamping members are interlocked with each other, so that three clamping members can be opened or closed simultaneously. Each clamping member has two projections 521 and 522, wherein the projection 521 is arranged in the bracket 9 and the projection 522 is arranged in the main body 51. When the main body 51 rotates relative to the sliding member 8, each clamping member rotates together with the main body. The clamping members 52*a*, 52*b* and 52*c* have a first position, as shown in FIGS. 6 and 7, where the three clamping members are closed upon each other to form a clamping area whereby the nail or other fastening elements can be engaged with the clamping members and retained in this area. The clamping members 52*a*, 52*b* and 52*c* have a second position, as shown in FIGS. 8 and 9, where the three clamping members are entirely opened with respect to each other to form a releasing area whereby the nail or other fastening elements can be disengaged from the clamping members, and the striking rod may pass through this releasing area to continuously strike the nail until the nail is completely nailed into the workpiece. When the clamping members are located at the second position (i.e., the completely opened position), the nail or other fastening elements can be placed in the receiving cavity 63, and then the clamping members may be closed, thus the nail or other fastening elements may be retained in the clamping area. The clamping member is adjustable, so the nail or other elements with different sizes could be retained independently by the clamping members.

A person skilled in the art will understand that the clamping members may be any one or any combination of elements selected from a group consisting of a chuck jaw, spring, magnet, bolt and chuck for retaining elements.

As shown in FIGS. 1, 2, 6 and 7, when assembled, a bush 10 may be movably nested on the striking rod 61. The main body 51 as a driving part is movably arranged on a stationary bush 11. The projections 522 of three clamping members are respectively arranged on the main body 51. Then, the bracket 9 is installed on the projections 522 of three clamping members. Three grooves 8*a* are provided in the sliding member 8, and the angle between each two grooves is 120° in the circumference direction of the sliding member. One end of each clamping member is respectively arranged in each of the three grooves 8*a*, so that the sliding member can slide relative to the clamping members in the grooves. The sliding member 8 is further provided with an inclined slot 12 and another inclined slot (not shown) in the position that rotates by 180° in the circumference direction of the sliding member. A pin 80 passes through the inclined slot 12 and is installed on the main body 51. The pin 80 may slide relative to the inclined slot 12, and with the sliding of the sliding member 8, the pin 80 slides relative to the inclined slot 12, thereby the main body 51 may be driven to rotate by the pin 80 relative to the sliding member 8, and the rotation of the main body 51 can drive the clamping members installed thereon to rotate. As a result, three clamping members can be gradually opened until they rotate to the completely opened position. A projection 8*b* is provided in the lower end of the sliding member 8. After the nail is completely nailed into the workpiece, the sliding member 8 is locked, and the clamping members are located at the completely opened position at the moment.

A first biasing device is in the form of a spring 13 for biasing the sliding member 8 towards the workpiece, so that the clamping members are located at the closed position. One end of the spring 13 is installed on the sliding member 8, and the other end is installed on the gearbox. When the sliding member 8 contacts the workpiece, the user has to overcome the pressure of the first biasing device to open the clamping members. A second biasing device is in the form of a spring 14 for biasing the bush 10 towards the workpiece. One end of the spring 14 is installed on the end of the bush 10, and the other end is installed on the stationary bush 11. When the bush 10 contacts the workpiece, the user has to overcome the pressure of the second biasing device. At this moment, the clamping members are completely opened, and the bush 10 may pass through the releasing area for preventing the nail from being blocked in any gap between the clamping members.

Figure 12:
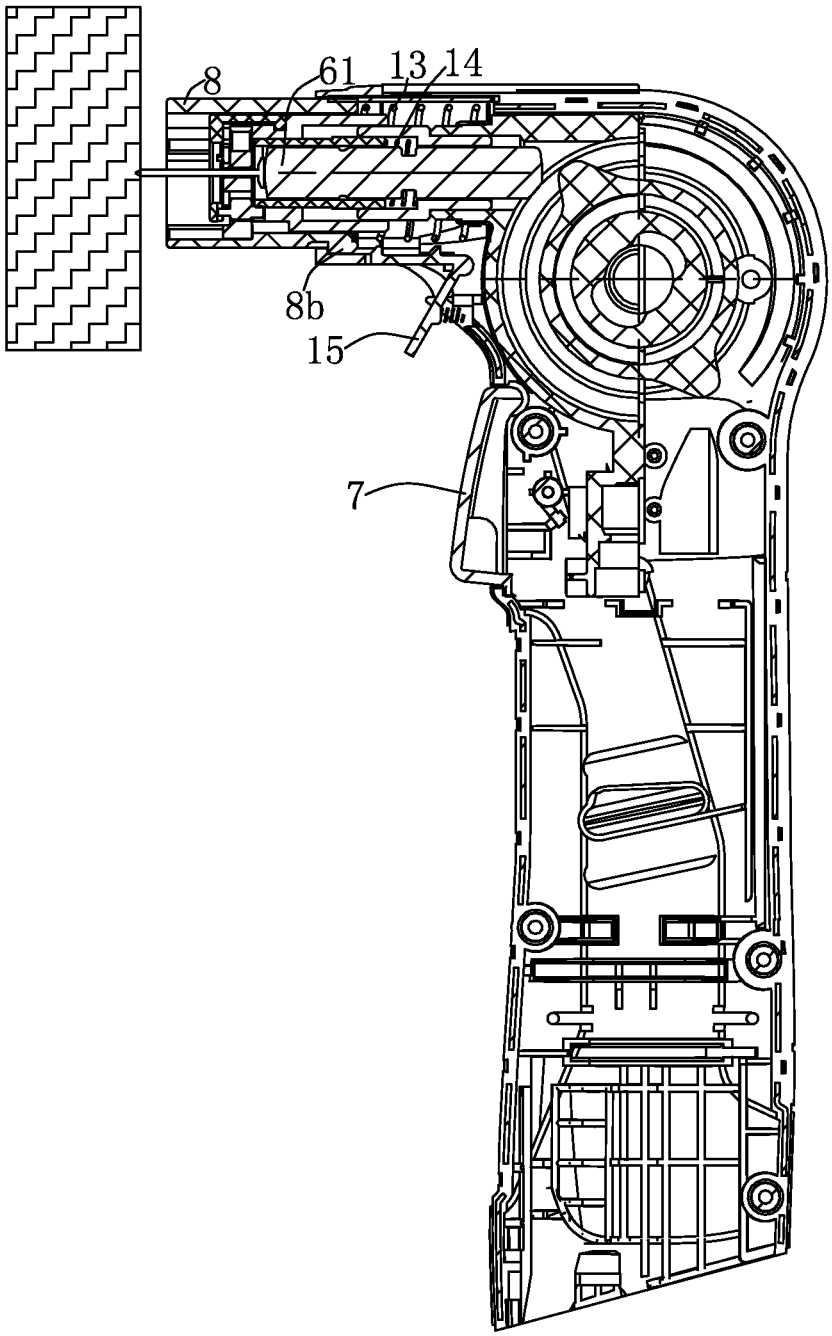
FIG. 12 is a view illustrating the auto hammer in FIG. 1 positioned on the workpiece.
Figure 13:
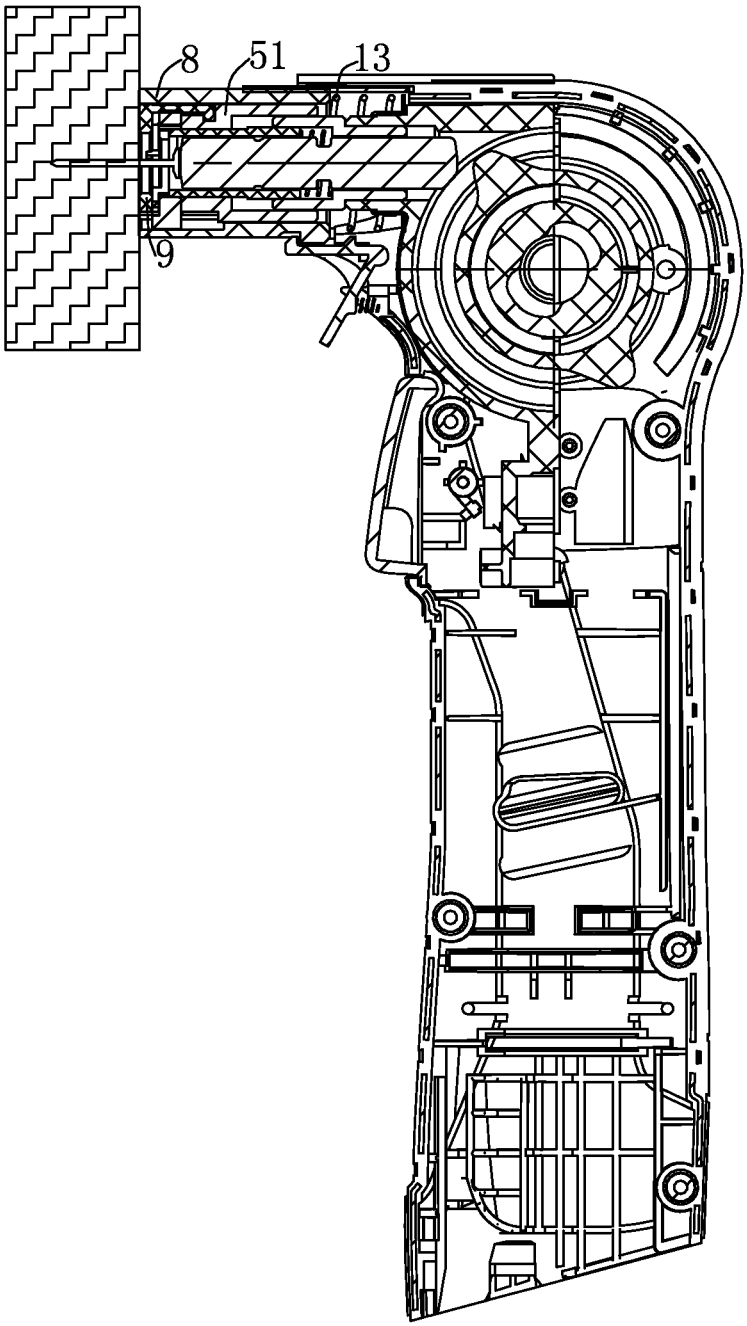
FIG. 13 is a view illustrating the bracket of the clamping mechanism of the auto hammer in FIG. 1 engaged with the workpiece.
Figure 14:
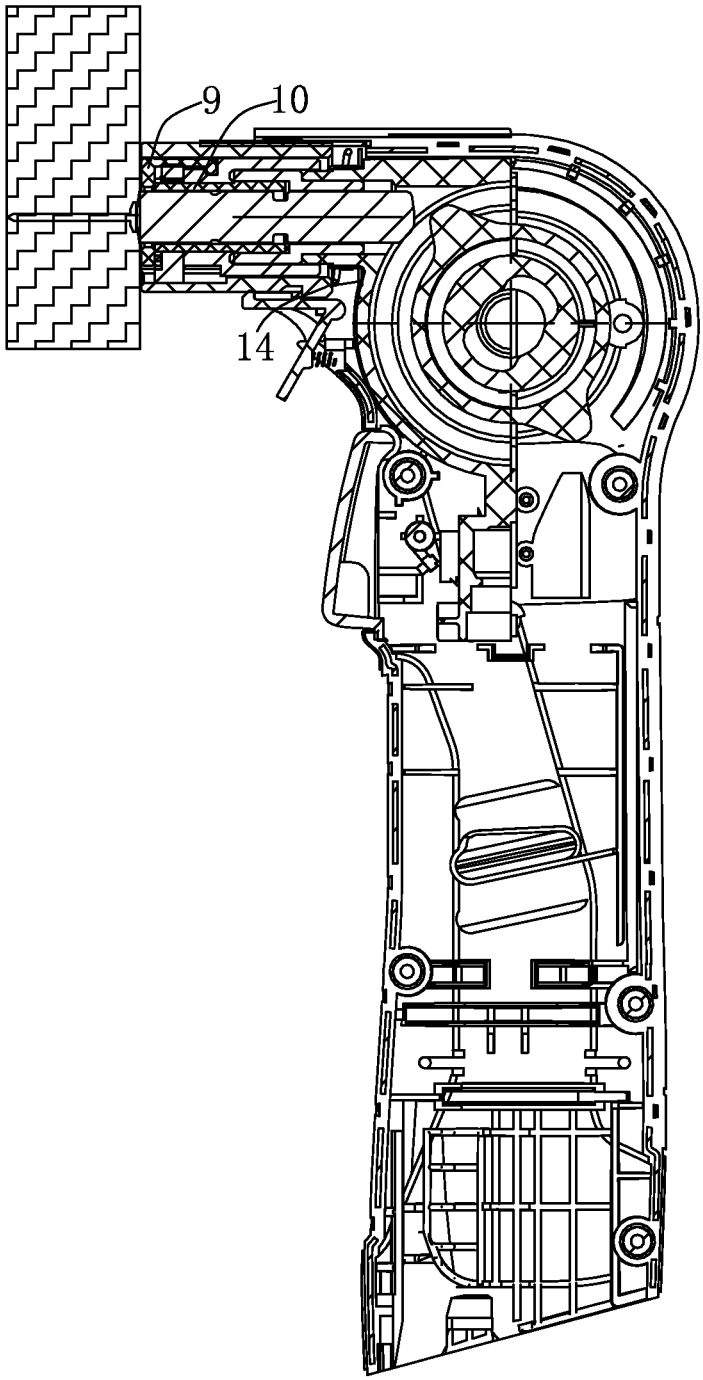
FIG. 14 is a view illustrating a fastening element being completely inserted into the workpiece.
Figure 15:
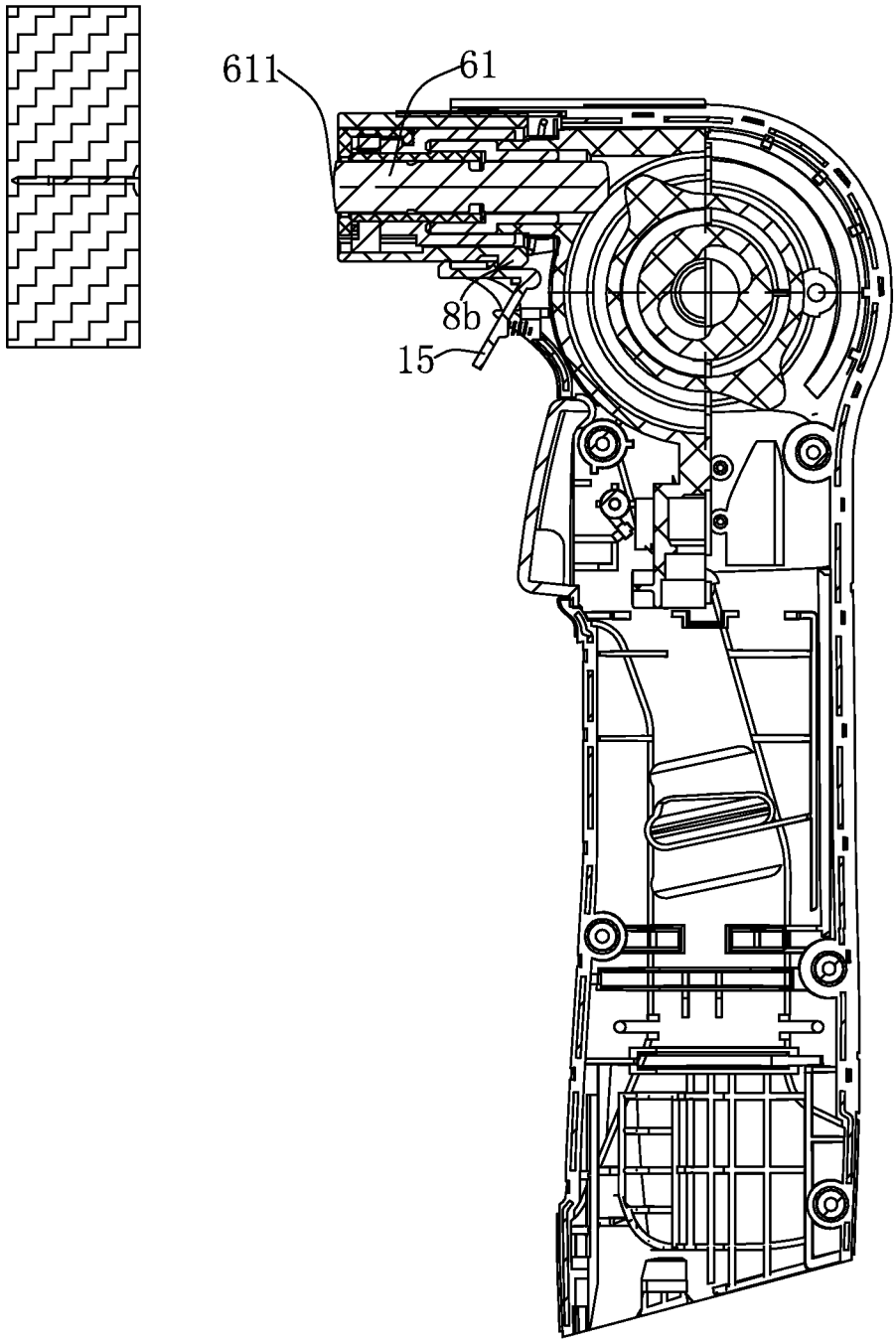
FIG. 15 is a view illustrating the striking rod emerged out of the sliding member.

As shown in FIGS. 12 to 15, during operation, if the clamping members are located at the closed position, the user has to overcome the pressure of the first biasing device 13 to push the sliding member 8 to move rightwards. The user may push the sliding member 8 directly, or push a spanner (not shown) provided on the housing 2 that engages with the sliding member, so as to overcome the spring force to open the clamping members, and the nail may be positioned in the receiving cavity 63. The clamping mechanism 5 also has a locking mechanism in the form of a projection 8*b* provided in the lower end of the sliding member. When the projection 8*b* is locked with the spanner, the clamping members are located at the opened position, then the spanner 15 is released and the nail can be retained independently by the clamping members, subsequently, the auto hammer is positioned in this way that the nail is adjacent to the workpiece, as shown in FIG. 12. Then the switch 7 is pressed to power the motor M and cause the striking rod 61 to move in a reciprocating manner. When the user pushes the auto hammer to the workpiece, the head of the nail is struck by the striking rod continuously so that the nail may be inserted into the workpiece gradually. During the gradually insertion of the nail, the user has to overcome the pressure of the spring 13 to open the clamping members when the sliding member 8 engages with the workpiece. This allows the nail to be partially inserted into the workpiece before being released. As shown in FIG. 13, when the end surface of the bracket 9 contacts the workpiece, the clamping members are located at the completely opened position, the sliding member 8 moves together with the main body 51 rightwards, and the projection 8*b* of the sliding member 8 pushes out the spanner 15 such that the sliding member 8 continues to move rightward. When the bush 10 contacts the bracket 9, the user has to overcome the pressure of the spring 14 to ensure that the bush 10 is always near the head of the nail so as to prevent the head of the nail being blocked in the gap formed between the clamping members located at the completely opened position. Then, the nail is struck continuously until the nail is completely inserted into the workpiece.

After the nail is completely inserted into the workpiece, the sliding member 8 is locked in the position where the clamping members are completely opened. Subsequently, another nail can be placed in the receiving cavity 63, and the spanner 15 is pressed such that the clamping members clamp the nail in the receiving cavity 63, and the above steps may be repeated for secondly striking the nail. In the locking mechanism of the clamping mechanism 5, the projection 8*b* in the lower end of the sliding member 8 may lock the sliding member 8 in another position, where the striking rod 61 is emerged out of the sliding member 8 such that the visibility of the striking rod 61 is enhanced. At that moment, the striking end 611 of the striking rod 61 may be used as the knocking part of the auto hammer for knocking the workpiece to be processed during the operation with the liner reciprocating movement of the striking rod 61, for example, knocking a tenon or a brick or the like, thus the functions of the device may be extended without limiting the function of the device to driving fasteners into a workpiece. In accordance with the present embodiment, the person skilled in the art could conceive that the sliding member 8 may be formed of transparent materials, such as transparent plastic, which may also enhance the visibility of the striking rod 61. When the user observes the specific position of the striking rod 61, he may use it as an auto hammer to knock the workpiece to be processed.

In conclusion, the auto hammer disclosed herein is not to be restricted to the described embodiments or the constructions shown in the drawings. Rather, any changes, substitutes and modifications in the configurations and positions of the components described and illustrated according to the spirit of the present invention will be regarded as falling within the range of the claims which follow.

What is claimed is:

1. An auto hammer, comprising:

a striking device including a striking rod for striking a component; and a clamping mechanism for releasably retaining the component proximate the striking device, the clamping mechanism comprising:

at least one clamping member;

a driving part; and a sliding member, wherein the at least one clamping member is pivotally arranged in the sliding member and operably connected to the driving part, and the driving part is rotatable relative to the sliding member so as to cause the at least one clamping member to rotate pivotally in the sliding member, and wherein the sliding member is reciprocally slidable in the direction of movement of the striking rod.

2. The auto hammer of claim 1, wherein the sliding member is provided with an inclined longitudinal slot and wherein a pin operatively coupled to the at least one clamping member passes through the inclined longitudinal slot and the driving part and moves along the inclined longitudinal slot.

3. The auto hammer of claim 1, further comprising a releasing area is formed when the clamping member is located in an opened position, and the striking rod is arranged to pass through the releasing area.

4. The auto hammer of claim 1, wherein the clamping mechanism further comprises a bush movably nested on the striking rod and a bracket installed on the at least one clamping member, wherein the bush engages with the bracket to prevent the component from entering a gap formed when the at least one clamping member is in an opened position.

5. The auto hammer of claim 1, wherein the clamping mechanism comprises a first biasing device for biasing the sliding member towards a workpiece into which the component is intended to be driven.

6. The auto hammer of claim 4, wherein the clamping mechanism further comprises a biasing device for biasing the bush towards a workpiece into which the component is intended to be driven.

7. The auto hammer of claim 1, wherein the clamping mechanism comprises a plurality of clamping members, and wherein each of the plurality of clamping members is interlocked with another of the plurality of clamping members.

8. The auto hammer of claim 1, wherein the clamping mechanism comprises a locking mechanism.

9. The auto hammer of claim 8, wherein the locking mechanism comprises a projection and a spanner.

10. The auto hammer of claim 9, wherein the clamping member is placed into an opened position when the projection and the spanner are interlocked.

11. The auto hammer of claim 9, wherein the striking rod is emerged out of the sliding member when the projection and the spanner are interlocked.

12. The auto hammer of claim 1, wherein the sliding member is made of a transparent material.

13. The auto hammer of claim 1, wherein the striking rod applies a striking force to the component to move it, and a transmitting mechanism is used to convert a rotational motion of a motor into a liner reciprocating motion of the striking rod to apply the striking force.

14. The auto hammer of claim 13, wherein the striking rod repeatedly strikes the component so that the component is gradually inserted into a workpiece.

15. The auto hammer of claim 13, wherein the transmitting mechanism comprises an impact wheel with at least one projection, and the projection applies a periodically impact motion to the striking rod.

* * * * *